US006810550B1

(12) United States Patent
Wuelknitz et al.

(10) Patent No.: US 6,810,550 B1
(45) Date of Patent: Nov. 2, 2004

(54) TOOTHBRUSH

(75) Inventors: Peter Wuelknitz, Leichlingen (DE); Ruediger Vetter, Duesseldorf (DE); Yvette Kosmetatou, Kifissia Athen (GR)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/030,761

(22) PCT Filed: Apr. 19, 2000

(86) PCT No.: PCT/EP00/03535

§ 371 (c)(1),
(2), (4) Date: Apr. 18, 2002

(87) PCT Pub. No.: WO00/65954

PCT Pub. Date: Nov. 9, 2000

(30) Foreign Application Priority Data

Apr. 28, 1999 (DE) ..... 199 19 196

(51) Int. Cl.[7] ..... A46B 9/04
(52) U.S. Cl. ..... 15/167.1; 15/167.2
(58) Field of Search ..... 15/167, 167.1, 15/167.2

(56) References Cited

U.S. PATENT DOCUMENTS 74,560 A * 2/1868 Maury ..... 15/167.1
2,797,424 A * 7/1957 Olson ..... 15/167.1
3,188,673 A * 6/1965 Newman ..... 15/167.1
3,295,156 A * 1/1967 Brant ..... 15/167.1
3,299,318 A * 1/1967 Clemens ..... 315/168
4,672,706 A * 6/1987 Hill ..... 15/167.1
5,165,761 A * 11/1992 Dirksing ..... 300/21
5,305,489 A * 4/1994 Lage ..... 15/167.1
6,322,152 B2 * 11/2001 Trojanowski et al. ..... 300/21
6,496,999 B1 * 12/2002 Gleason et al. ..... 15/167.1

FOREIGN PATENT DOCUMENTS

| | | |
|---|---|---|
| DE | 41 38 777 | 5/1993 |
| EP | 0 458 999 | 12/1991 |
| EP | 0 619 711 | 11/1992 |
| EP | 0 639 340 | 2/1995 |
| GB | 2 092 437 | 8/1982 |
| WO | WO98/38889 | 9/1998 |

* cited by examiner

*Primary Examiner*—Cathy Lam
(74) *Attorney, Agent, or Firm*—Stephen D. Harper; Gregory M. Hill; Glenn E. J. Murphy

(57) ABSTRACT

The toothbrush consists of a brush head with bunches of bristles (2, 3, 4) arranged in a longitudinal bristle bed (1) and a handle (6), which is connected to the bristle bed (1) by a connecting part (5). The length of the bunches of bristles (3, 4) varies in the longitudinal direction of the bristle bed (1) in a wave shape. The first bunches of bristles (2) are situated at the two outer sides of the bristle bed (1), have split bristle ends and are of essentially the same length. The second bunches of bristles (3, 4), whose length varies in the longitudinal direction of the bristle bed (1), are situated between the two outer sides of the bristle bed (1). The inventive toothbrush has an improved cleaning action, especially for interdental spaces but also for the gingival line.

20 Claims, 2 Drawing Sheets

TOOTHBRUSH

CROSS-REFERENCE TO RELATED APPLICATIONS

This application is the U.S. National Stage application filed under 35 U.S.C. § 371 of International Application No. PCT/EP00/03535, filed Apr. 19, 2000, in the European Patent Office, claiming priority under 35 U.S.C. §§ 119 and 365 of PCT/EP00/03535 and DE 199 19 196.4, filed on Apr. 28, 1999, in the German Patent Office.

The invention relates to a toothbrush, consisting of a brush head with bunches of bristles arranged in an elongate bristle bed and a handle connected with the bristle bed by way of a connecting part, wherein the bunches of bristles have a length varying in wave shape in longitudinal direction of the bristle bed.

In the case of the horizontal manner of cleaning normally used by the user with known toothbrushes a good cleaning effect is indeed achieved, since the moving filaments of the toothbrush produce a rapid distribution of toothpaste at the tooth and wipe the toothpaste over the surface of the teeth, whereby surface contaminants are picked up, dispersed and thus eliminated. However, in use of a toothbrush with a usual planar bristle field the interdental regions which are particularly cariogenic are left out, as the bristles have no contact with the tooth surface in such tooth interstices.

There is therefore known from EP 0 619 711 B1 a profile, which extends sinusoidally in longitudinal direction of the bristle bed, of the bunches of bristles of a toothbrush, in which the points of maximum amplitude substantially coincide with the gaps formed between the teeth of the user. All bristles have rounded ends in order to avoid harm to teeth and gums by sharp edges. An improvement in cleaning effect in the interdental region is thus achieved, since the elevated bristles are better able to penetrate into the depressions of the tooth interstices.

DESCRIPTION OF THE INVENTION

However, in the case of cleaning the outer side of the teeth the edge of the gum is strongly stressed, which is not only unpleasant, but can also lead to injury to the gum notwithstanding the rounded bristle ends. This applies particularly when a stronger pressure on the toothbrush is exerted for improvement in the cleaning effect. The user therefore avoids vigorous brushing of the outer side of the teeth, with the result that not only the outer side of the teeth and the edge of the gum, but also the interdental region are cleaned only to an inadequate degree. The same applies to the inner side of the teeth.

A further disadvantage of the known toothbrush, as well as toothbrushes with an entirely planar bristle field, resides in the fact that a large part of the applied toothpaste leaves the bristle field unused even after the first brushing motions and is no longer able to contribute to the cleaning.

The invention has the object of developing a toothbrush with an enhanced cleaning performance, particularly for the tooth interstices, but also for the gum edge.

According to the invention this object is met in the case of the toothbrush of the kind stated in the introduction in that first bunches of bristles are arranged at the two outer sides of the bristle bed and have split bristle ends and substantially the same length and that second bunches of bristles, which have a length varying in wave shape in longitudinal direction of the bristle bed, are arranged between the two outer sides of the bristle bed.

Due to the outwardly disposed first bunches of bristles with split bristle ends the edge of the gum is stressed significantly less, so that the user does not shy away from brushing with increased pressure, so that a thorough cleaning of the outer side of the teeth and above all the teeth interstices is achieved by means of the inner bristles formed in wave shape. At the same time, the split bristle ends of the outwardly disposed bunches of bristles clean the edge of the gum particularly gently and thoroughly by the high number of filament ends and distribute the toothpaste particularly effectively at the surface of the tooth and the gum. Thus, a significant feature of the invention is the combination of inner bristles having a length varying in wave shape with outer bristles having frayed, thus split, ends.

The first and second bunches of bristles consist of the same or a comparable material, namely of high-grade synthetic materials, particularly Nylon 66 or similar. The diameter of the bristles (filaments) preferably lies at 0.1 to 0.25 mm, especially at 0.15 to 0.225 mm. Each bunch of bristles comprises forty to sixty bristles, wherein in the case of the so-called anchor method twenty to thirty bristles are preferred.

Moreover, it is proposed on the one hand that the upper ends of the outwardly disposed first bunches of bristles are arranged above the lowermost ends of the inwardly disposed second bunches of bristles. On the other hand, it is of advantage if the upper ends of the outwardly disposed first bunches of bristles extend beyond the highest ends of the inwardly disposed (short) second bunches of bristles by at most 1 mm and in particular extend at most up to the highest ends of the inwardly disposed (long) bunches of bristles.

Several advantages with respect to improvement in the cleaning effect are thus achieved. Firstly, the outwardly disposed bristles are sufficiently short in order to allow the inner bristles to be effective for cleaning the interdental regions and the outer sides of the teeth. In the case of too-long outer bristles a "stilt effect" would in fact occur so that the ends of the inner bristles would no longer have contact with the outer sides of the teeth and in particular with the teeth interstices. Secondly, the outwardly disposed bristles are, however, also of sufficient length to prevent contact of the inner bristles with the edge of the gum. Thirdly, the outer bristles limit, by a minimum length of that kind, the "wave troughs" formed by the inner bristles, so that the toothpaste delivered to the inner bristles is available for a longer time for improving the cleaning performance and does not leave the bristle field as quickly as in the case of conventional toothbrushes.

In addition, it is proposed that the depth of splitting of the outwardly disposed first bunches of bristles is up to 4 mm, especially up to 2 mm. Moreover, it is of advantage if five to ten outwardly disposed first bunches of bristles are provided per row of bunches.

The inwardly disposed second bunches of bristles preferably have a length (depth of cut), measured from bristle base up to the ends, of 8 to 14 mm, especially 9 to 12.5 mm. For achieving a particularly good cleaning performance it is proposed that the length difference of the second bunches of bristles lies at 1 to 2 mm. The ends of the second bristles are—by contrast to the split ends of the first bristles—not split, but rounded off in order to ensure an additional security against harm to the gum.

It is preferred, moreover, that the inwardly disposed second bunches of bristles are arranged in rows extending transversely to the longitudinal axis of the bristle bed, wherein one to two rows of bristle bunches with short bristles, especially with the same bristle length, alternate with one to two rows of bristle bunches with long bristles, especially with the same bristle length. In order to achieve an optimal cleaning performance, the region of the short bristles, measured in longitudinal direction of the bristle bed, between the adjacent long bristles should have a length of 6 to 10 mm.

Further advantageous refinements of the invention for enhancement of the cleaning effect of the toothbrush, which relate not only to the first bunches of bristles, but also the second bunches of bristles, are stated in the following. The spacing between the centre points of adjacent bunches of bristles, measured at the bristle base, should amount to 1.5 to 3.5 mm, especially 2.0 to 3.0 mm. With this spacing such a flexibility of the bunches of bristles is achieved that the cleaning performance is further improved during cleaning of the teeth. Moreover, it is preferred that twenty to thirty inner bunches of bristles, especially twenty-three to twenty-eight bunches of bristles, are provided.

Further important refinements of the invention which concern the general construction of the toothbrush and contribute to meeting the object in accordance with the invention are explained in the following. The ergonomy of the toothbrush is particularly important for a good cleaning result. That relates particularly to cleaning of the teeth seated in the rearward region of the oral cavity, thus the molar teeth and wisdom teeth. The connecting part between the bristle bed and the handle, which is also termed bridge, should therefore have a diameter of not more than 10 mm. A bridge with an oval cross-section, wherein the longer axis lies in the plane of the bristle bed and should have a length of 5 to 7 mm, is preferred. The shorter axis perpendicular thereto preferably has a length of 4 to 6 mm. The ratio of the longer axis to the shorter axis should be about 1.1–1.5 to 1 at the handle. Since the longer axis lies in the plane of the bristle bed, a lateral deflection of the bristle bed during cleaning of the teeth is prevented, but a yielding of the bristle bed perpendicularly to this plane is facilitated so that there is compensation for excessive pressure on the toothbrush.

The connecting part (bridge) can taper from the handle connection to the connection of the bristle bed by up to 60% of the original diameter.

The angle between the bristle bed and the bridge on the one hand and the handle on the other hand should—in the sense of the ergonomy of the toothbrush—lie at 3° to 10°, especially at 5° to 9°, so that the molar teeth in particular can be reached significantly better. The plane formed by the bristle bed, the bridge and the handle is preferably perpendicular to the plane of the bristle bed.

An embodiment of the invention is described in more detail in the following by reference to drawings, in which.

In all drawings the same reference numerals have the same significance and if applicable are therefore explained only once.

The toothbrush consists, in per se known manner, essentially of four parts, namely an elongate flat bristle bed 1 which is equipped with forty bunches 2, 3, 4 of bristles and is connected by way of a connecting part (bridge) 5 with the handle 6. In the present case the connecting part 5, which is integral with the bristle bed 1 and injection-moulded from plastics material, is anchored within the handle 6, which is injection-moulded from a transparent plastics material.

Figure 1:
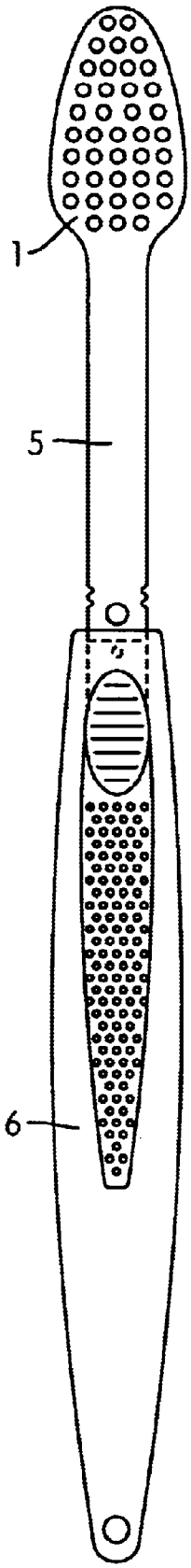
FIG. 1 shows a plan view of a toothbrush according to the invention.
Figure 2:
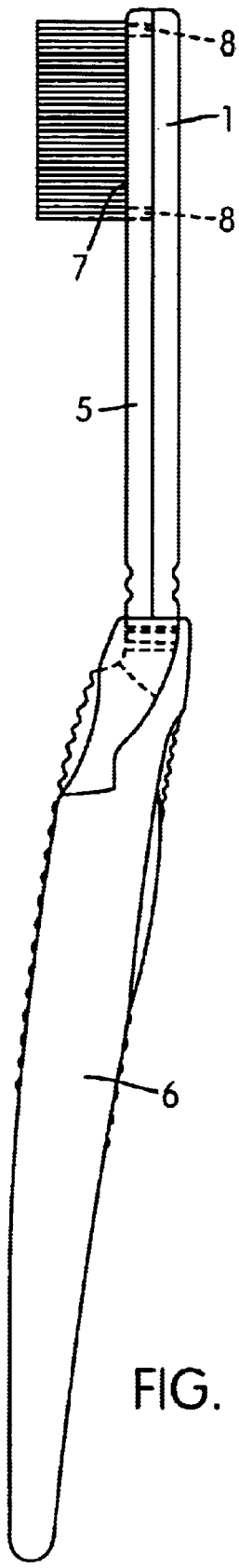
FIG. 2 shows a side view of the toothbrush according to FIG. 1.

The already mentioned angle between the bristle bed 1 and the bridge 5 on the one hand and the handle 6 on the other hand is clearly apparent from FIG. 2. There, however, the bunches of bristles are illustrated only schematically.

Figure 3:
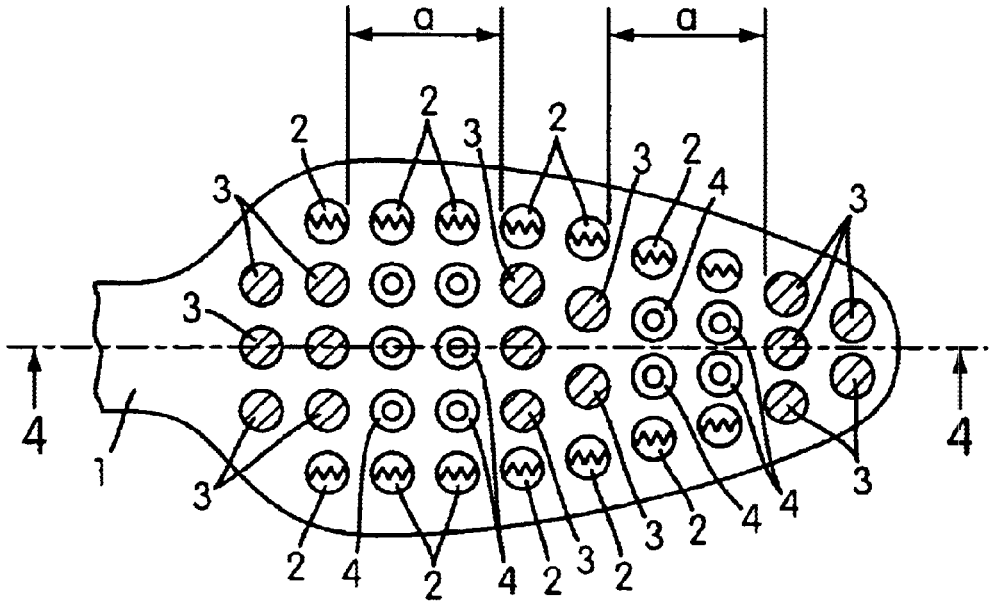
FIG. 3 shows a plan view, to enlarged scale, of the bristle bed, which is equipped with bristles, of the toothbrush according to FIGS. 1 and 2
Figure 4:
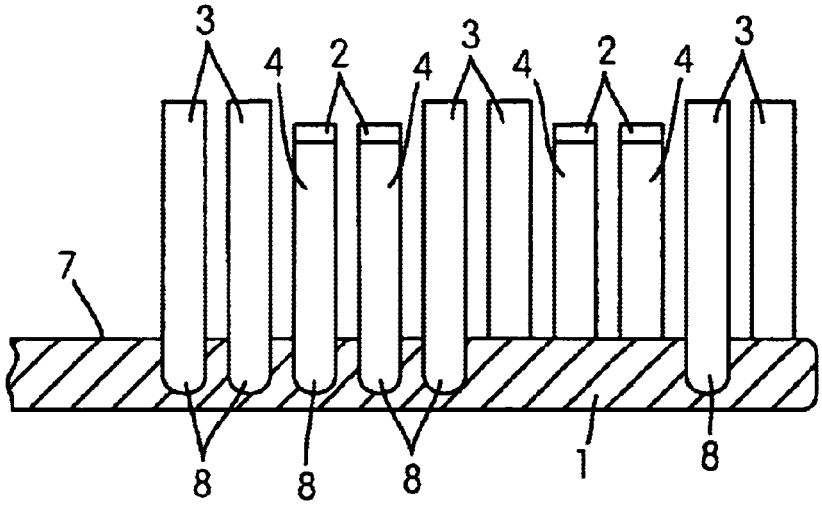
FIG. 4 shows a section IV—IV in FIG. 3.

The height of the bunches 2, 3, 4 of bristles, which consist of polyamide, and the arrangement thereof on the bristle bed 1 is best evident from FIGS. 3 and 4. Two outer rows each of seven first bunches 2 of bristles of average height, namely with a length of 10.8 mm above the bristle base 7, partly enclose ten rows, which extend transversely to the longitudinal axis of the bristle bed 1, of second bunches 3, 4 of bristles. In this inner region in each instance two rows of long bunches 3 of bristles with a length of 11.5 mm above the bristle base 7 alternate—viewed in longitudinal direction of the bristle bed 1—with two rows of short bunches 4 of bristles with a length of 10.1 mm above the bristle base 7. The inner long bunches 3 of bristles (second bunches of bristles) are characterised in FIG. 3 by hatching, the inner short bunches 4 of bristles (second bunches of bristles) by a small circle and the outer, split bunches 2 of bristles (first bunches of bristles) by a zig-zag line. The length differences of the bunches of bristles are particularly clear in FIG. 4. Here the outer bunches 2 of bristles, which are at the back in this illustration, protrude beyond the front short bunches of bristles and are therefore actually visible in FIG. 4.

The ends of the outer bristles are frayed (split) with a depth of splitting of about 1 mm. Moreover, it is important that the region of the second bunches 4 of bristles, measured in longitudinal direction of the bristle bed 1, between the adjoining long bunches 3 of bristles has a length a of 8 mm (FIG. 3).

The bunches 2, 3, 4 of bristles are anchored in bores 8, which have a diameter of 1.7 mm and a spacing of 2.5 mm measured from centre point to centre point of adjacent bunches of bristles.

Reference Numeral List

1 bristle bed
2 outer bunch of bristles, first bunch of bristles
3 inner long bunch of bristles, second bunch of bristles
4 inner short bunch of bristles, second bunch of bristles
5 connecting part (bridge)
6 handle
7 bristle base
8 bore

What is claimed is:

1. A toothbrush comprising a brush head having a plurality of bristle bunches arranged in an elongate bristle bed, said bed having a longitudinal axis and two outer sides arranged substantially in the elongate direction of the bed, and a handle connected to the brush head by a connecting part, wherein a first set of bristle bunches is arranged at the two outer sides of the bristle bed, the bristle ends thereof comprising split bristle ends of substantially the same length, and wherein a second set of bristle bunches is arranged between the two outer sides of the bristle bed, the bristle ends thereof forming a wave shape profile longitudinally in the bristle bed.

2. The toothbrush of claim 1, wherein the first set of bristle bunches is disposed outwardly from the second set of bristle bunches, the bristles of the first set of bristle bunches having uppermost ends and the bristles of the second set of bristle bunches having lowermost ends, wherein the uppermost ends of the bristles of the first set of bristle bunches extend further from the brush head than the lowermost ends of the bristles of the second set of bristle bunches.

3. The toothbrush of claim 1, wherein the first set of bristle bunches is disposed outwardly from the second set of bristle bunches, the bristles of the first set of bristle bunches having uppermost ends and the bristles of the second set of bristle bunches having uppermost ends, wherein the uppermost ends of the bristles of the first set of bristle bunches extend from the brush head by an equal to at most 1 mm greater length than the uppermost ends of the bristles of the second set of bristle bunches.

4. The toothbrush of claim 2, wherein the first set of bristle bunches is disposed outwardly from the second set of bristle bunches, the bristles of the first set of bristle bunches having uppermost ends and the bristles of the second set of bristle bunches having uppermost ends, wherein the uppermost ends of the bristles of the first set of bristle bunches extend from the brush head by an equal to at most 1 mm greater length than the uppermost ends of the bristles of the second set of bristle bunches.

5. The toothbrush of claim 1, wherein the bristles of the first set of bristle bunches are split up to 4 mm from their ends.

6. The toothbrush of claim 5, wherein the bristles of the first set of bristle bunches are split up to 2 mm from their ends.

7. The toothbrush of claim 1, wherein the first set of bristle bunches are arranged in one or more rows of bristle bunches at each of the two outer sides of the brush head, wherein each row of bristle bunches comprising the first set of bristle bunches comprises five to ten bunches of bristles per row.

8. The toothbrush of claim 1, wherein the second set of bristle bunches comprise bristles having a length of 8 mm to 14 mm measured from the brush head.

9. The toothbrush of claim 8, wherein the second set of bristle bunches comprise bristles having a length of 9.5 mm to 12 mm measured from the brush head.

10. The toothbrush of claim 1, wherein bristles of the second set of bristle bunches, having a length measured from the brush head that varies in wave shape in the elongate direction of the bristle bed, varying in length in wave shape from 1 mm to 2 mm.

11. The toothbrush of claim 1, wherein the ends of the bristles of the second set of bristle bunches are rounded.

12. The toothbrush of claim 1, wherein the second set of bristle bunches comprises a plurality of rows of bristle bunches arranged in rows extending transversely to the longitudinal axis of the bristle bed, in which second set of bristle bunches one to two rows of shorter bristle bunches alternate with one to two rows of longer bristle bunches.

13. The toothbrush of claim 12, wherein the rows of shorter bristles form a region 6 mm to 10 mm long measured on the longitudinal axis of the bristle bed between the adjacent rows of longer bristles.

14. The toothbrush of claim 1, wherein the bristle bunches are spaced 1.5 mm to 3.5 mm apart.

15. The toothbrush of claim 14, wherein the bristle bunches are spaced 2.0 mm to 3.0 mm apart.

16. The toothbrush of claim 1, wherein the second set of bristle bunches comprises twenty to thirty bristle bunches and the first set of bristle bunches comprises ten to twenty bristle bunches.

17. The toothbrush of claim 16, wherein the second set of bristle bunches comprises twenty-three to twenty-eight bristle bunches.

18. The toothbrush of claim 12, wherein the second set of bristle bunches comprises a plurality of rows of bristle bunches arranged in rows extending transversely to the longitudinal axis of the bristle bed, in which the second set of bristle bunches consists of one to two rows of shorter bristle bunches, the bristles thereof having the same length alternating with one to two rows of longer bristle bunches.

19. The toothbrush of claim 12, wherein the second set of bristle bunches comprises a plurality of rows of bristle bunches arranged in rows extending transversely to the longitudinal axis of the bristle bed, in which the second set of bristle bunches consists of one to two rows of shorter bristle bunches alternating with one to two rows of longer bristle bunches, the bristles thereof having the same length.

20. The toothbrush of claim 12, wherein the second set of bristle bunches comprises a plurality of rows of bristle bunches arranged in rows extending transversely to the longitudinal axis of the bristle bed, in which the second set of bristle bunches consists of one to two rows of shorter bristle bunches, the bristles thereof having the same lengths alternating with one to two rows of longer bristle bunches, the bristles thereof having the same length.

* * * * *

UNITED STATES PATENT AND TRADEMARK OFFICE

CERTIFICATE OF CORRECTION

PATENT NO. : 6,810,550 B1
DATED : November 2, 2004
INVENTOR(S) : Wuelknitz et al.

It is certified that error appears in the above-identified patent and that said Letters Patent is hereby corrected as shown below:

Title page,
Item [75], Inventors, please add -- Susanne Wittig, Koeln (DE) --.

Column 6,
Line 43, delete “lengths” and insert therefore -- length, --.

Signed and Sealed this

Fifth Day of April, 2005

JON W. DUDAS
*Director of the United States Patent and Trademark Office*